US007374261B1

(12) United States Patent
Wang

(10) Patent No.: US 7,374,261 B1
(45) Date of Patent: May 20, 2008

(54) PUSH-OPEN TYPE SLIDE STRUCTURE

(75) Inventor: Chun-Ping Wang, Taipei Hsien (TW)

(73) Assignee: Dynaslide Corporation, Taipei Hsien (TW)

( * ) Notice: Subject to any disclaimer, the term of this patent is extended or adjusted under 35 U.S.C. 154(b) by 0 days.

(21) Appl. No.: 11/635,597

(22) Filed: Dec. 8, 2006

(51) Int. Cl.
*A47B 88/04* (2006.01)

(52) U.S. Cl. ..... 312/333; 312/319.1

(58) Field of Classification Search ..... 312/330.1, 312/333, 334.1, 334.7, 334.8, 334.44, 334.46, 312/334.47, 319.1; 384/21, 22
See application file for complete search history.

(56) References Cited

U.S. PATENT DOCUMENTS 6,799,817 B1 * 10/2004 Chu ..... 312/333
6,979,066 B2 * 12/2005 Yang ..... 312/333
6,997,528 B2 * 2/2006 Yang ..... 312/333
7,244,005 B1 * 7/2007 Lu ..... 312/333
2005/0093406 A1 * 5/2005 Yang ..... 312/333

FOREIGN PATENT DOCUMENTS

KR 2001-0269498 * 3/2002

* cited by examiner

*Primary Examiner*—James O. Hansen
(74) *Attorney, Agent, or Firm*—Troxell Law Office, PLLC

(57) ABSTRACT

A push-open type slide structure comprises a top fastener and a locking device between an outer slide rail and a pull rod. The loading plate is extended from one side of the center portion of the main body. Two pillars are extended from both sides of the main body. A positioning fastener is coupled with the loading plate. A hook is mounted on the inner edge of the loading plate. A guide pillar is mounted on the rear end of the loading plate. The hook is inserted into the action trench of the main body and coupled with the elastic device. The locking device has a connection part for coupling with a guide part and a shaft holder. The push-open type slide structure is lockable or unlockable by pivotal rotation between the loading plate and the locking device. As a result, the push-open type slide structure can be controlled easily.

2 Claims, 8 Drawing Sheets

PUSH-OPEN TYPE SLIDE STRUCTURE

FIELD OF THE INVENTION

The present invention relates to a slide structure, and more particularly to a push-open type slide structure that acts as a hidden handle to allow the drawer to be push-opened easily.

BACKGROUND OF THE INVENTION

Generally speaking, the slide structures, which are applied to the drawers of general servers or computer desks, are composed of two or three-staged slide rail components and one or two bearings. In addition, the drawers are opened or closed by sliding the slide structures, wherein the aforesaid two or three-staged slide rail components have respective rail segments, which are outward pullable.

However, these conventional two or three-staged slide rail components, which are not interlocked together, can be pulled outward easily. In other words, if the cabinets are shifted or slanted or if the drawers are excessively pulled out, the drawers may be opened completely. If several drawers are opened simultaneously, the cabinets may be thus toppled down.

SUMMARY OF THE INVENTION

In order to improve the foregoing conventional problems, the present invention discloses an inter-locking push-open slide structure.

A major object of the present invention is to disclose a push-open type slide structure, wherein the push-open type slide structure can be locked or unlocked easily by pushing the pull rod.

Another object of the present invention is to form a stupid protection trench on the loading plate so as to allow the guide pillar to be downward shifted elastically, thereby preventing the guide pillar from damage.

A further object of the present invention is to provide a push-open type slide structure that acts as the hidden handle of the drawer, wherein a gap that facilitates the step for opening the drawer is formed between the drawer and the cabinet by pushing the push-open type slide structure.

A further object of the present invention is to disclose a top fastener and a locking device, which are easily attachable without complicated locking structure, so that the push-open type slide structure is easily assemblable so as to save time and labor power significantly.

DETAILED DESCRIPTION OF THE PREFERRED EMBODIMENT

Figure 1:
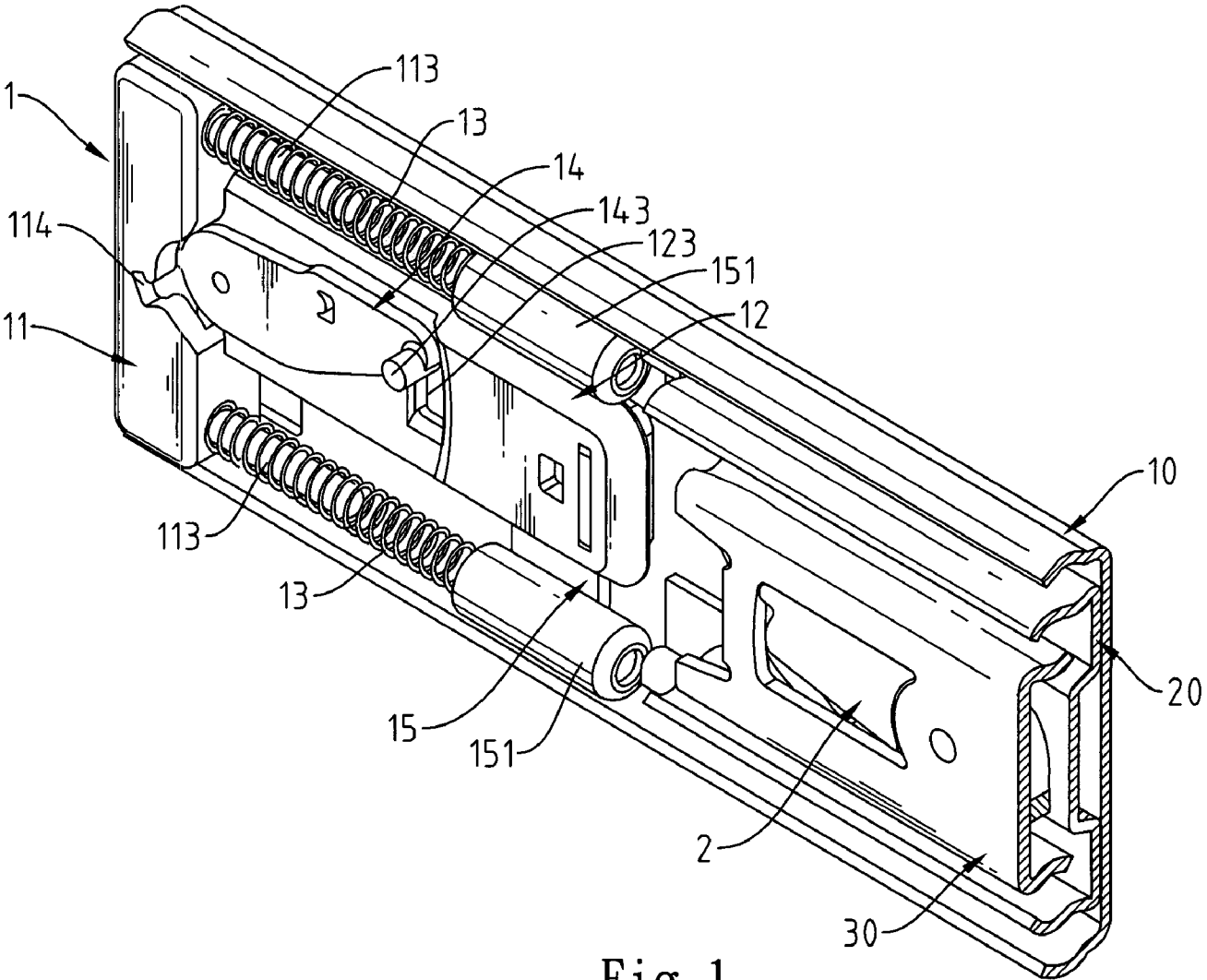
FIG. 1 is an elevational diagram of the present invention.
Figure 2:
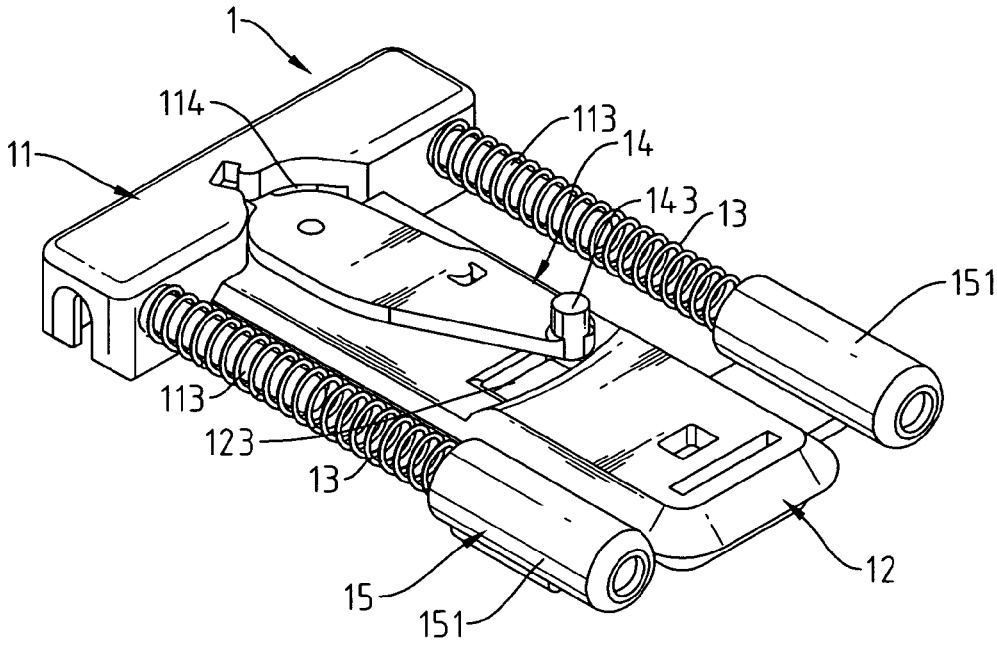
FIG. 2 is an elevational view showing the top fastener of the present invention.
Figure 3:
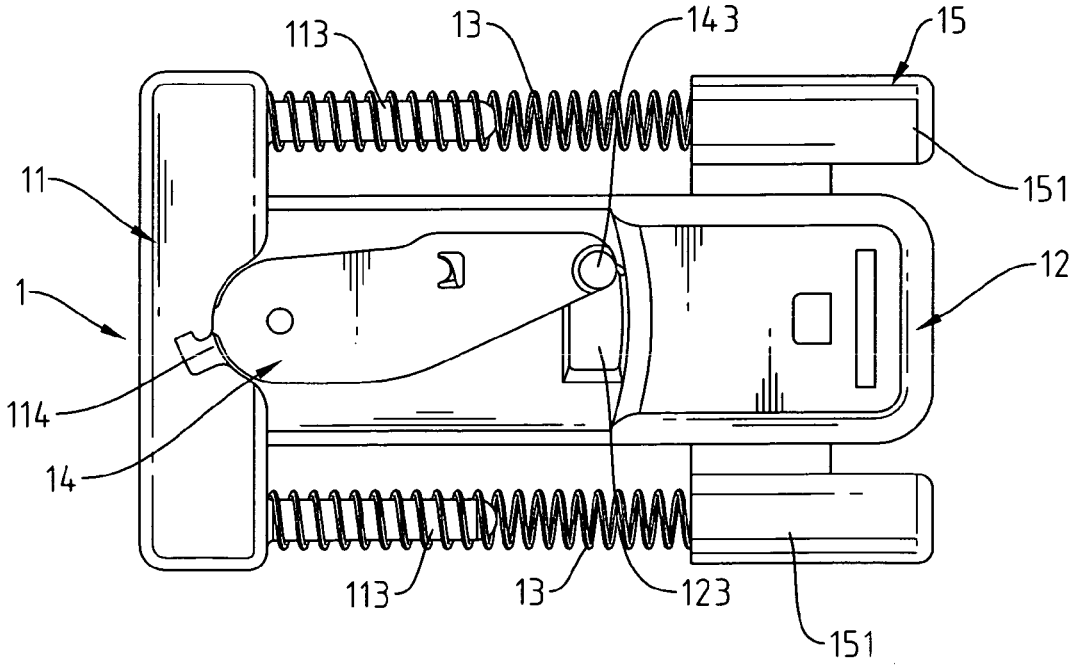
FIG. 3 is a top plan view showing the top fastener of the present invention.
Figure 4:
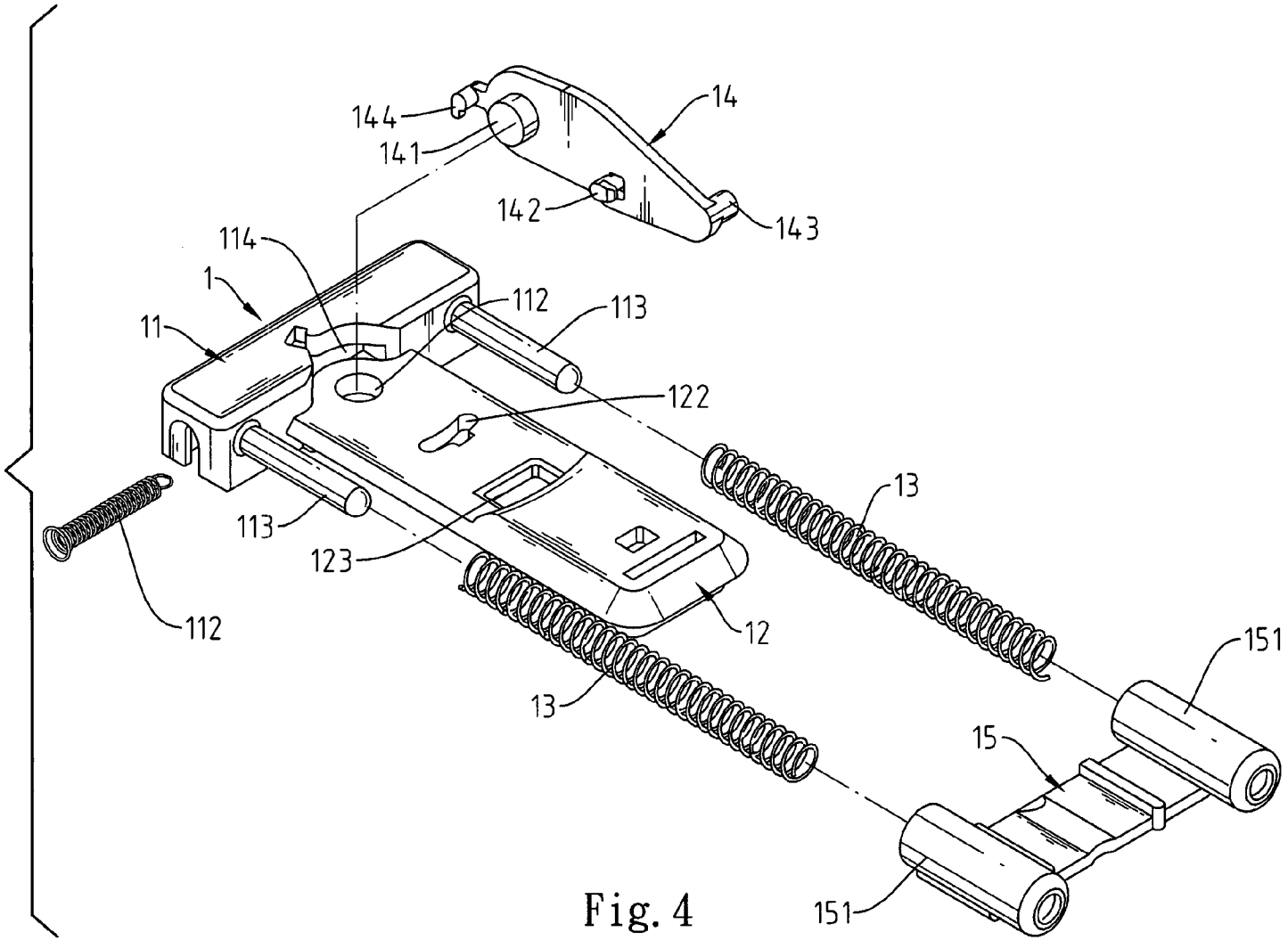
FIG. 4 is an elevational, decomposed view showing the top fastener of the present invention.
Figure 5:
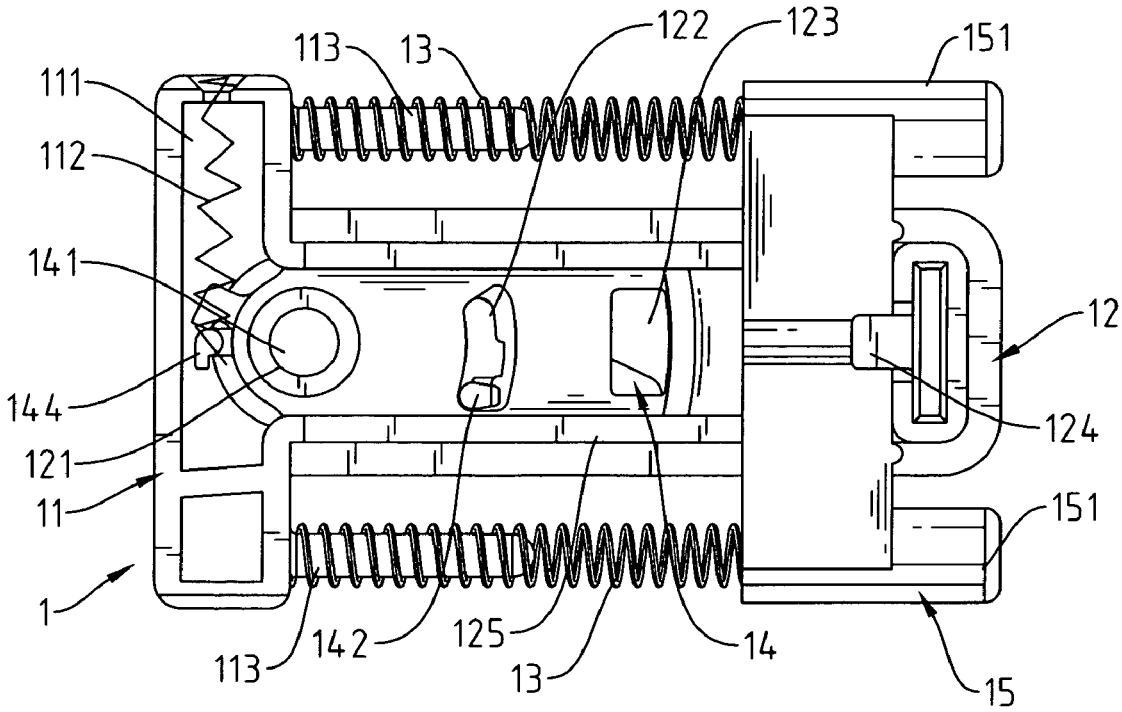
FIG. 5 is a rear plan view showing the top fastener of the present invention.
Figure 6:
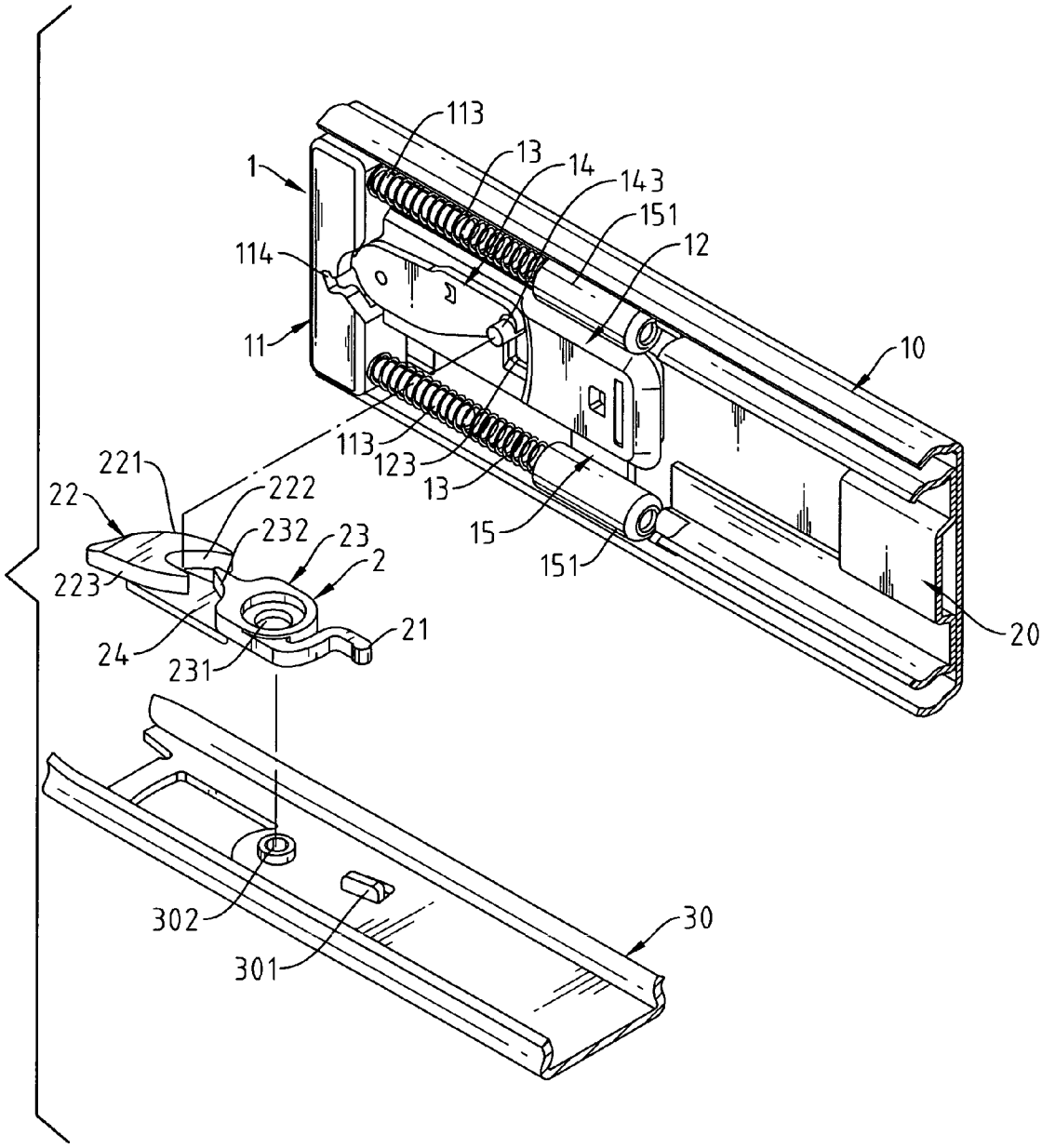
FIG. 6 is an elevational view showing the locking structure of the present invention.
Figure 7:
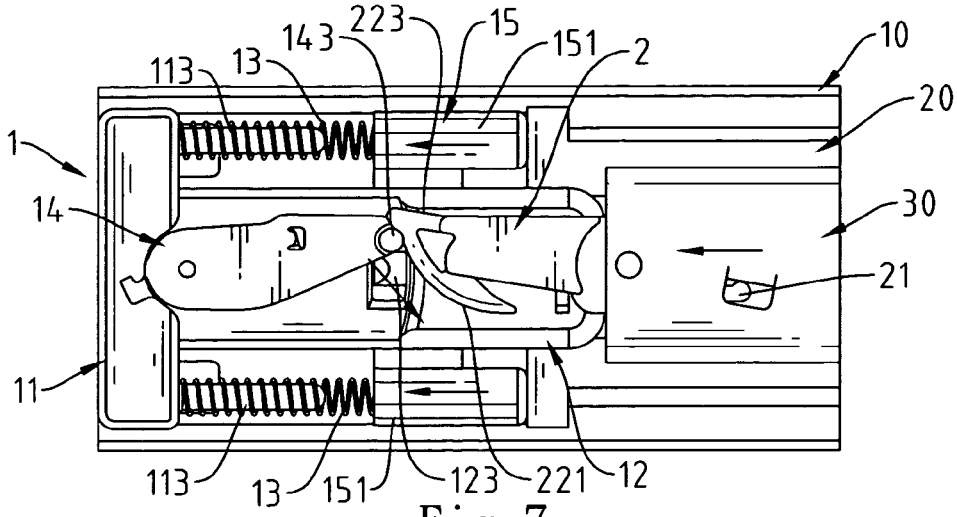
FIG. 7 is a diagram showing a first locking status of the present invention.
Figure 8:
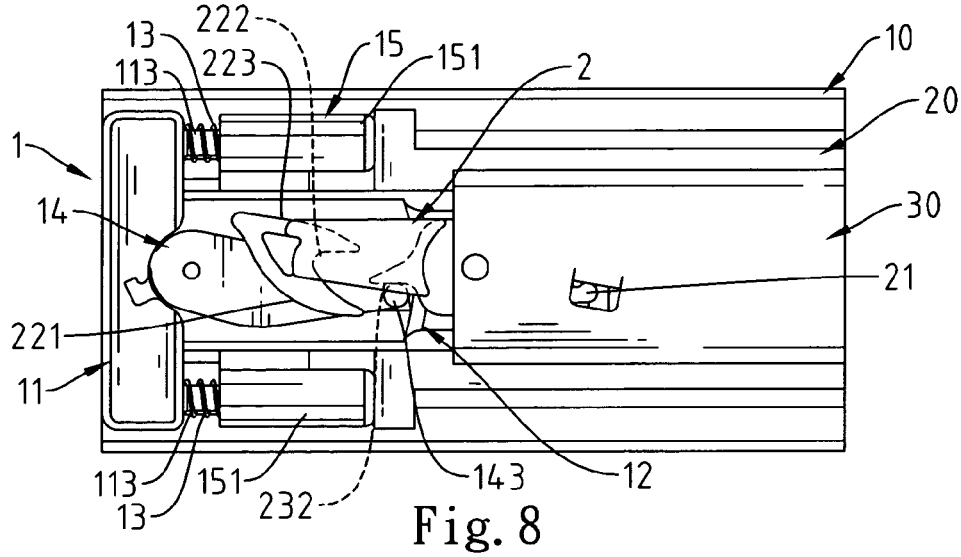
FIG. 8 is a diagram showing a second locking status of the present invention.
Figure 9:
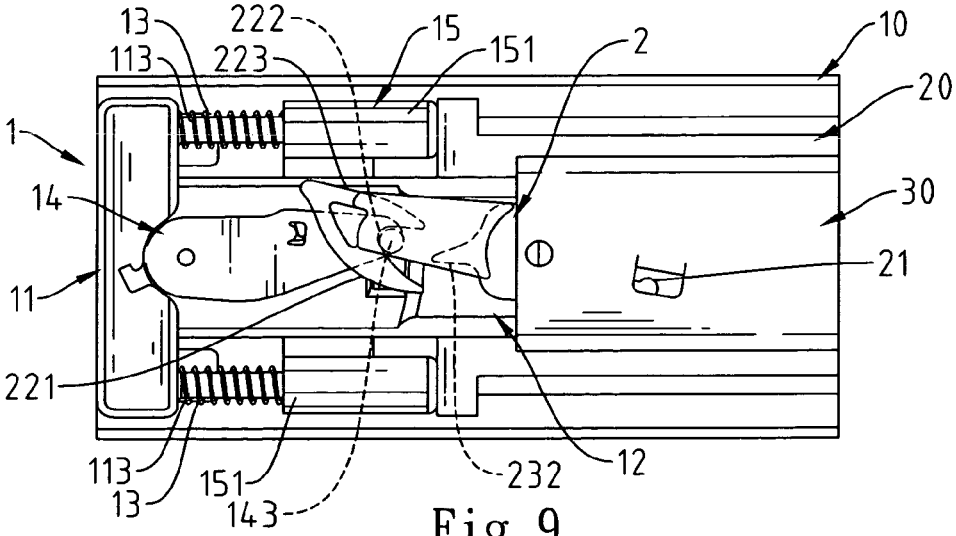
FIG. 9 is a diagram showing a third locking status of the present invention.

Referring to FIG. 1 through FIG. 6, a push-open type slide structure of the present invention is generally for forward or backward shifting a carried object. The push-open type slide structure comprises an outer slide rail 10, an inner slide rail 20, and a pull rod 30, wherein the inner slide rail 20 is held inside the outer slide rail 10, and the pull rod 30 is coupled with the inside of the inner slide rail 20 so that the inner slide rail 20 can be shifted by pulling the pull rod 30 so as to forward or backward shift the carried object.

In the present invention, a top fastener 1 and a locking device 2 are mounted between the outer slide rail 10 and the pull rod 30 so that the carried object can be push-opened by controlling the engagement between the top fastener 1 and the locking device 2.

The top fastener 1 comprises a main body 11, a loading plate 12, and a pair of elastic devices 13, a positioning fastener 14, and a sliding sleeve 15, wherein the main body 11 and the loading plate 12 are integrally connected to each other. The loading plate 12 is extended from one side of the center portion of the main body 11, and two pillars 113 are extended from both sides of the main body 11, respectively. An action trench 114 is formed on the connection portion between the main body 11 and the loading plate 12, wherein this action trench 114 is communicated with a holding trench 111 on the backside of the main body 11. An elastic device 112 is mounted on the inside of the holding trench 111.

A shaft hole 121, a slideway 122, and a stupid protection trench 123 are formed on the surface of the loading plate 12. Two slide rails 125 are formed on the backside of the loading plate 12. A positioning plate 124 is mounted on the rear ends of the slide rails 125.

A shaft 141 and a protrudent part 142 are mounted on the bottom surface of the positioning fastener 14. A hook 144 is mounted on the inner edge of the positioning fastener 14. A guide pillar 143 is mounted on the rear end of the positioning fastener 14. The shaft 141 of the positioning fastener 14 is held in the shaft hole 121, wherein the protrudent part 142 is exactly coupled with the inside of the slideway 122. The hook 144 is inserted into the action trench 114 of the main body 11, and coupled with the elastic device 112 mounted inside the holding trench 111. If the shaft 141 of the positioning fastener 14 is pivotally rotated inside the shaft hole 121, the rotation angle of the positioning fastener 14 can be limited by the protrudent part 142, which is coupled with the inside of the slideway 122. In addition, the hook 144 can shift the elastic device 112 so that the positioning fastener 14 can retrieve its normal position by using the elastic device 112.

The elastic devices 13 are sleeved onto the pillars 113 of the main body 11, respectively.

Two sleeves 151 are mounted on both sides of the sliding sleeve 15, respectively, and coupled with the elastic devices 13, respectively. The sliding sleeve 15 is coupled with the lower portion of the loading plate 12, and the sliding sleeve 15 is slideable on the slide rails 125 of the loading plate 12.

In addition, the sliding distance of the sliding sleeve 15 can be limited by the positioning plate 124.

The bottom surfaces of the aforesaid holding trench 111 and sliding sleeve 15 of the main body 11 of the top fastener 1 are both fixedly coupled with the outer slide rail 10.

Referring to FIG. 1 and FIG. 6 again, a protrudent plate 301 and a shaft 302 are mounted on the internal surface of the pull rod 30 for fixedly coupling with the locking device 2. The locking device 2 has a connection part 24 for coupling with a guide part 22 and a shaft holder 23. The guide part 22 and the shaft holder 23 are protrudent from the upper portion of the connection part 24. The connection part 24 is fixedly inserted into the pull rod 30. The guide part 22 of the locking device 2 has a guide edge 221, an inclined plane 223, and a recessed trench 222, which constitute an arrow structure jointly. The shaft holder 23 has an edge protrusion 232 spaced from the recessed trench 222 by a certain distance so as to a form a tunnel. The locking device 2 has a positioning hook 21 on the rear end for hooking the protrudent plate 301 of the pull rod 30. The shaft 302 is inserted into a shaft hole 231.

Referring further to FIG. 1 and FIG. 7 through FIG. 9, if there is a need to lock the push-open type slide structure of the present invention, the inner slide rail 20 is pushed and shifted inward to lean against the sleeves 151 on both sides of the sliding sleeve 15 of the top fastener 1. In addition, when the pull rod 30 is shifted inward to lean against the inner slide rail 20, the inner slide rail 20 is also shifted by the pull rod 30 so that the sliding sleeve 15 is also shifted inward to compress the elastic devices 13. When the pull rod 30 is shifted inward by a certain degree, the locking device 2 on the pull rod 30 can touch the guide pillar 143 by the guide part 22, and guide it along the guide edge 221 of the guide part 22 so as to position the guide pillar 143 in the recessed trench 222 smoothly. After positioning the guide pillar 143 in the recessed trench 222, the top fastener 1 and the locking device 2 can be interlocked together so as to achieve the purpose of locking the push-open type slide structure.

Figure 10:
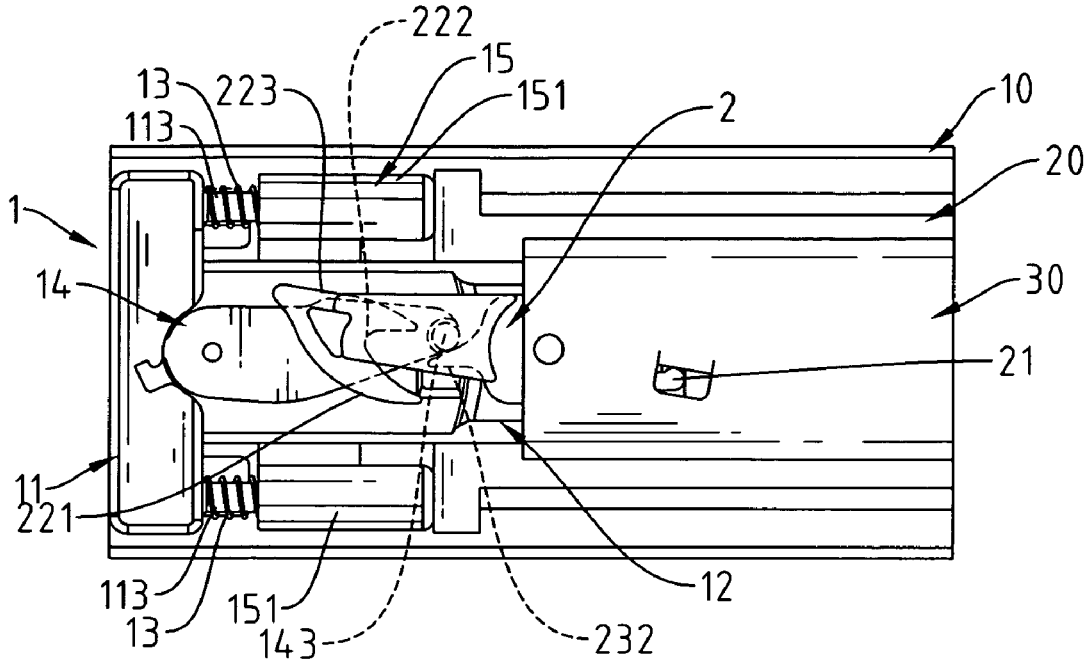
FIG. 10 is a diagram showing a first unlocking status of the present invention.
Figure 11:
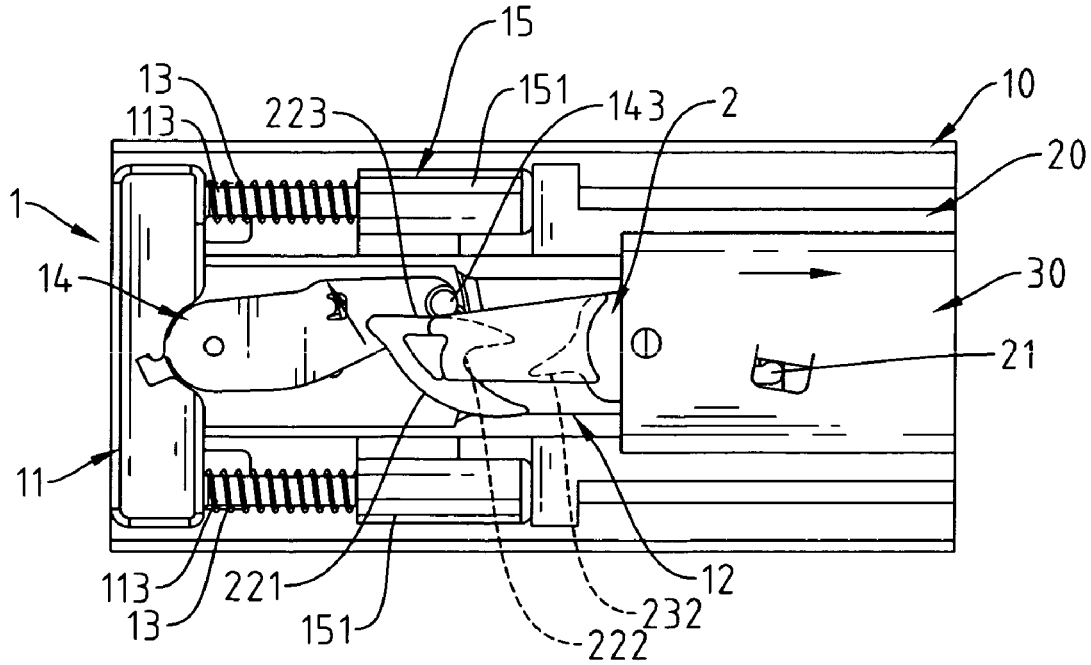
FIG. 11 is a diagram showing a second unlocking status of the present invention.

Referring to FIG. 10 and FIG. 11, if there is a need to unlock the push-open type slide structure, the pull rod 30 must be pushed again so that the guide pillar 143, which is previously inserted into the recessed trench 222, can be pushed outward to the outside of the opening of the recessed trench 222 so as to retrieve its previous position along the inclined plane 223. At this moment, the pull rod 30 is disengaged from the top fastener 1 and the elastic devices 13 can push the inner slide rail 20 outward by using the sliding sleeve 15 so that the carried object can be shifted outward easily by using a gap formed by upward pushing the push-open type slide structure.

The push-open type slide structure is lockable or unlockable by pivotal rotation between the loading plate 12 and the locking device 2. This push-open type slide structure is applicable to a desk drawer, a drawer of computer desk, a cabinet of industrial server or computer. This drawer can be locked or unlocked by applying force to the push-open type slide structures on both sides. Accordingly, the push-open type slide structure can be adopted as a hidden handle so as to beautify the drawer. In addition, it is very easy to operate the push-open type slide structure, and this drawer can be opened easily.

Figure 12:
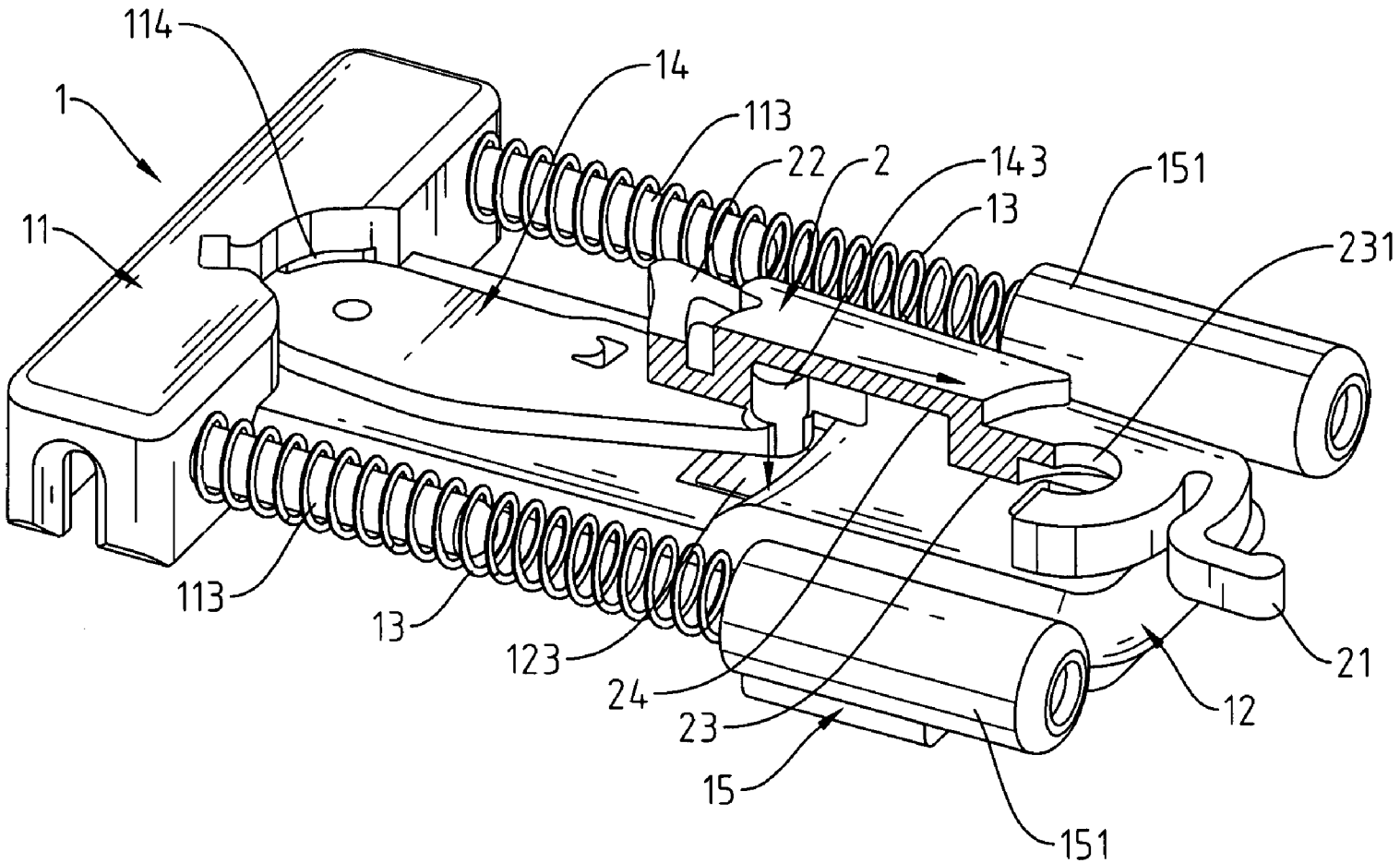
FIG. 12 is a diagram showing the stupid protection structure of the present invention.

In addition, referring to FIG. 1 and FIG. 12, the push-open type slide structure may be damaged if the operator tries to open the drawer in a wrong manner. In view of this, the stupid protection trench 123 is specially formed on the loading plate 12 underneath the location of the guide pillar 143 of the positioning fastener 14. As a result, if the drawer is opened improperly, the pull force that pulls the pull rod 30 can drive the locking device 2 on the pull rod 30 to trigger the loading plate 12, so the guide pillar 143, which is protrudent from the loading plate 12, is most easily damaged. In this regard, the stupid protection trench 123 allows the guide pillar 143 to be downward shifted elastically so as to prevent the guide pillar 143 from damage.

What the invention claimed is:

1. A push-open type slide structure comprising:

a top fastener and a locking device mounted between an outer slide rail and a pull rod;

said top fastener comprising a main body, a loading plate, a pair of first elastic devices, a positioning fastener, and a sliding sleeve, said loading plate being extended from one side of a center portion of said main body, two pillars being extended from both sides of said main body, respectively, an action trench being formed on a connection portion between said main body and said loading plate, said action trench being communicated with a holding trench on the backside of said main body, a second elastic device being mounted on the inside of said holding trench;

said loading plate having a shaft hole and a slideway on a surface and slide rails on the backside of said loading plate;

said positioning fastener having a shaft and a protrudent part on a bottom surface, a hook on an inner edge, and a guide pillar on a rear end, said shaft of said positioning fastener being held in said shaft hole, said protrudent part being exactly coupled with the inside of said slideway, said hook being inserted into said action trench of said main body and coupled with said second elastic device;

said pair of first elastic device being sleeved onto said pillars of said main body;

two sleeves being mounted on both sides of said sliding sleeve and coupled with said pair of first elastic devices, respectively, said sliding sleeve being coupled with a lower portion of said loading plate, said sliding sleeve being slideable on said slide rails of said loading plate; and said locking device being fixed on said pull rod, said locking device having a connection part for coupling with a guide part and a shaft holder, said guide part of said locking device having a guide edge, an inclined plane, and a recessed trench, said shaft holder having an edge protrusion spaced from said recessed trench by a certain distance so as to a form a tunnel.

2. A push-open type slide structure claim 1, wherein a protection trench is formed on said loading plate underneath the location of said guide pillar of said positioning fastener.

* * * * *